US007832244B2

(12) United States Patent
Jensen et al.

(10) Patent No.: US 7,832,244 B2
(45) Date of Patent: Nov. 16, 2010

(54) CONTROLLING FLUID PRESSURE IN A HYDROFORMING PROCESS

(75) Inventors: David R. Jensen, Swartz Creek, MI (US); Mike M. Ghiran, Lake Orion, MI (US); Paul D. Larsen, Fenton, MI (US); Terry A. Kent, East China, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 345 days.

(21) Appl. No.: 12/047,339

(22) Filed: Mar. 13, 2008

(65) Prior Publication Data

US 2009/0229333 A1 Sep. 17, 2009

(51) Int. Cl.
*B21D 39/08* (2006.01)
*B23P 23/00* (2006.01)

(52) U.S. Cl. ..... 72/57; 72/60; 29/421.1

(58) Field of Classification Search ..... 72/56, 72/57, 60, 63; 29/421.1
See application file for complete search history.

(56) References Cited

U.S. PATENT DOCUMENTS 4,470,280 A * 9/1984 Kelly ..... 72/61
4,721,028 A * 1/1988 Lucas et al. ..... 91/433
6,493,913 B2 * 12/2002 Streubel et al. ..... 72/58
6,938,449 B2 * 9/2005 Kusunoki et al. ..... 72/57

FOREIGN PATENT DOCUMENTS

EP 0633075 A1 1/1995

* cited by examiner

*Primary Examiner*—David B Jones

(57) ABSTRACT

A system for hydroforming a workpiece containing fluid at elevated pressure includes a die in which the workpiece is formed, a source of control pressure, a tank at low pressure, and a valve that includes a displaceable control element that alternately moves between an open state and a closed state, opening and closing, respectively, a passage that hydraulically connects the fluid in the workpiece and the tank in response to the relative magnitudes of a first force applied to the control element by the control pressure source and a second force applied to the control element by pressure of the fluid in the workpiece acting on the control element in opposition to the first force.

16 Claims, 2 Drawing Sheets

CONTROLLING FLUID PRESSURE IN A HYDROFORMING PROCESS

BACKGROUND OF INVENTION

The present invention relates generally to hydroforming a workpiece in a die, and, more particularly, to controlling the magnitude of fluid pressure in a workpiece during an automated hydroforming operation.

Hydroforming is a specialized type of die forming process that uses high pressure hydraulic fluid to force a malleable workpiece into contact with the inner surface of a die. Hydroforming is a cost-effective way of shaping metal, such as aluminum, into a product, especially a product having a complex shape. For example, in the automotive industry, hydroforming is used to produce strong, light, rigid unibody structures for vehicles.

To hydroform metal into a vehicle frame rail using an automated process, a hollow, tubular metal workpiece is placed inside a negative die that has the shape of the desired frame rail. Water at high pressure flows into the metal workpiece, and the die is closed around the workpiece. Then the water pressure is increased to a very high magnitude causing the workpiece to expand against the die until it conforms to the shape of the die. The die is then opened, the hydroformed frame rail is removed from the die, and the operation is repeated with another workpiece.

Complex shapes with concavities, which would be difficult or impossible to produce as a standard solid die stamping, can be readily produced by hydroforming. Hydroformed parts can often be made with a higher stiffness to weight ratio and at a lower per unit cost than traditional stamped or stamped and welded parts.

A need exists to control accurately and reliably the fill and form pressure of the water in the workpiece throughout the operation such that the part is pressurized at each stage of the operation with an optimum pressure that varies with the physical properties of the material, the shape and the size of part being formed.

SUMMARY OF INVENTION

An embodiment contemplates hydroforming a workpiece containing fluid at elevated pressure in a die in which the workpiece is formed, a source of control pressure, a tank at low pressure, and a valve that includes a displaceable control element that alternately moves between an open state and a closed state, opening and closing, respectively, a passage that hydraulically connects the fluid in the workpiece and the tank in response to the relative magnitudes of a first force applied to the control element by the control pressure source and a second force applied to the control element by pressure of the fluid in the workpiece acting on the control element in opposition to the first force.

An advantage of an embodiment is the provision of accurate, variable fill and form fluid pressures in a hydroform process using a single stage proportional relief valve. The single stage proportional relief valve simplifies the hydraulic circuit, eliminates shock from the system during a transition from the fill-phase to the form-phase of the hydroforming process, and incorporates inexpensive, commercial hydraulic cylinder to control water pressure.

The single stage valve has fewer hydraulic components and a lower cost relative to a double stage control valve. The single stage proportional relief valve requires no shuttle valve, includes only a single pressure chamber, produces no pressure drop, characteristic of a shuttle valve shifting between multiple pressure chambers, and avoids any delay required for a shuttle valve to shift and oil pressure to be reestablished after the shuttle.

Water pressure increases along a ramp from the fill pressure to the form pressure, thereby eliminating need for a directional valve to re-direct oil flow from a small bore cylinder to a larger bore cylinder.

DETAILED DESCRIPTION

Figure 1:
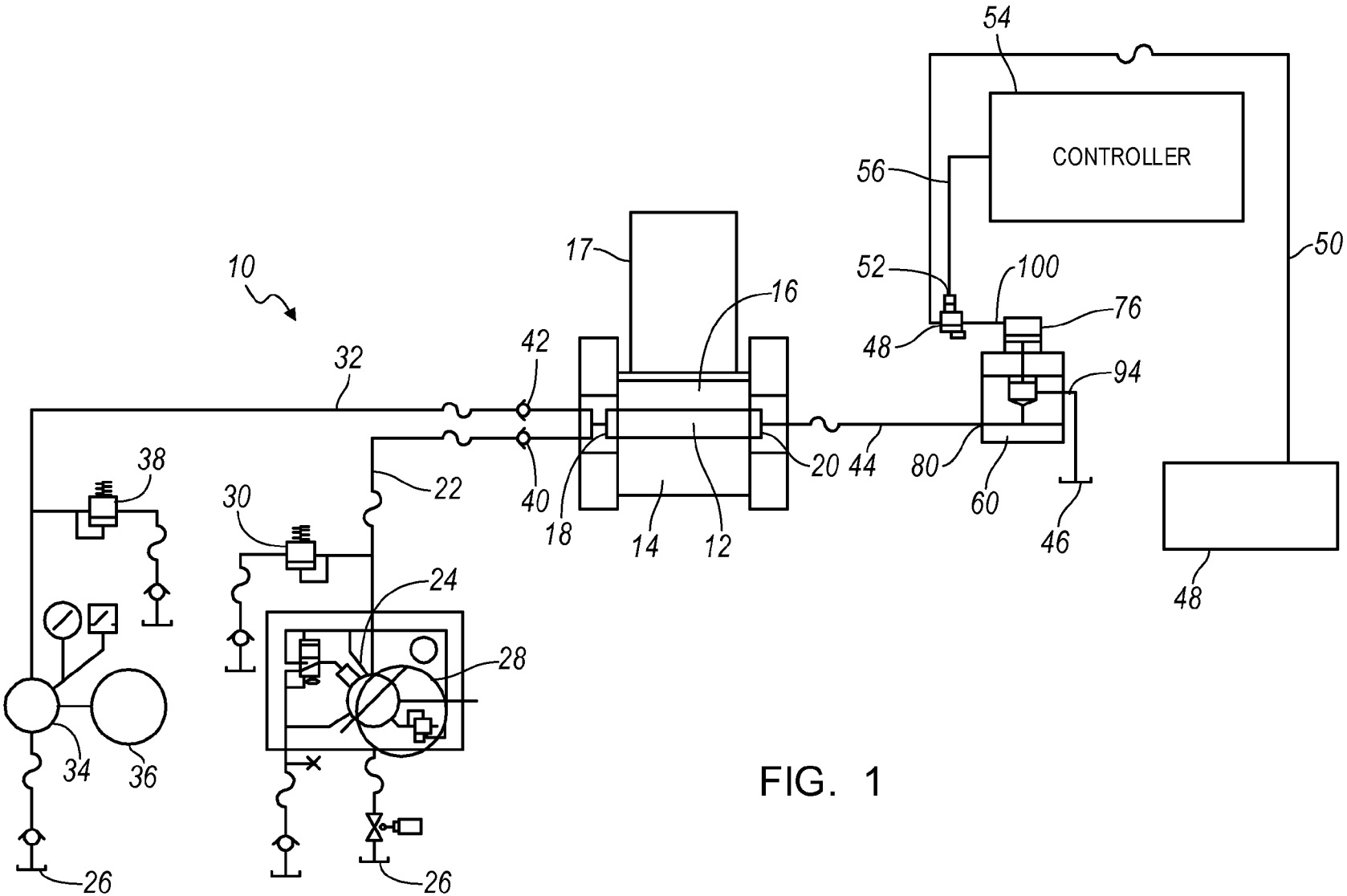
FIG. 1 is a schematic diagram illustrating a hydraulic system for operating and controlling a hydroforming process.

The system 10 shown in FIG. 1 for hydroforming a workpiece 12 includes a die having two parts 14, 16, which open to allow an unformed workpiece to be inserted into or removed from the die and close to form the workpiece in the die. The workpiece 12 may be a metal tube having open ends 18, 20 connected, respectively, to sources of pressurized water and to a valve that controls pressure in the workpiece. A press 17 opens and closes the die parts 14, 16. The interior of workpiece 12 communicates through its first end 18 and a low pressure line 22 to a fill pump 24, which draws water from a reservoir 26 and is driven by an electric motor 28. A safety relief valve 30 maintains pressure in line 22 below a reference pressure. The interior of workpiece 12 communicates through its first end 18 and a high pressure line 32 to a form pump 34, which draws water from reservoir 26 and is driven by an electric motor 36. A second safety relief valve 38 maintains pressure in line 32 below a second reference pressure. Check valves 40, 42 prevent flow from the workpiece 12 toward the pumps 24, 34, respectively.

The interior of workpiece 12 communicates through its second end 20 and a high pressure line 44 with a single stage proportional fill/form pressure control valve 60, which regulates pressure in line 44 and workpiece 12 by alternately opening and closing a connection to a low pressure scavenge water tank or reservoir 46 in response to a control pressure. A source of high pressure control pressure 48 communicates through a high pressure oil line 50 with a cylinder 76 of valve 60. A hydraulic proportional pressure relief valve 48, communicating with line 50, regulates pressure in line 50, which is supplied to cylinder 76 as a variable control pressure. The hydraulic proportional pressure relief valve 48 includes a solenoid 52, which responds to electronic control signals produced by an electronic controller 54 and carried to the solenoid on line 56, thereby producing the variable control pressure that is supplied to cylinder 76.

Figure 2:
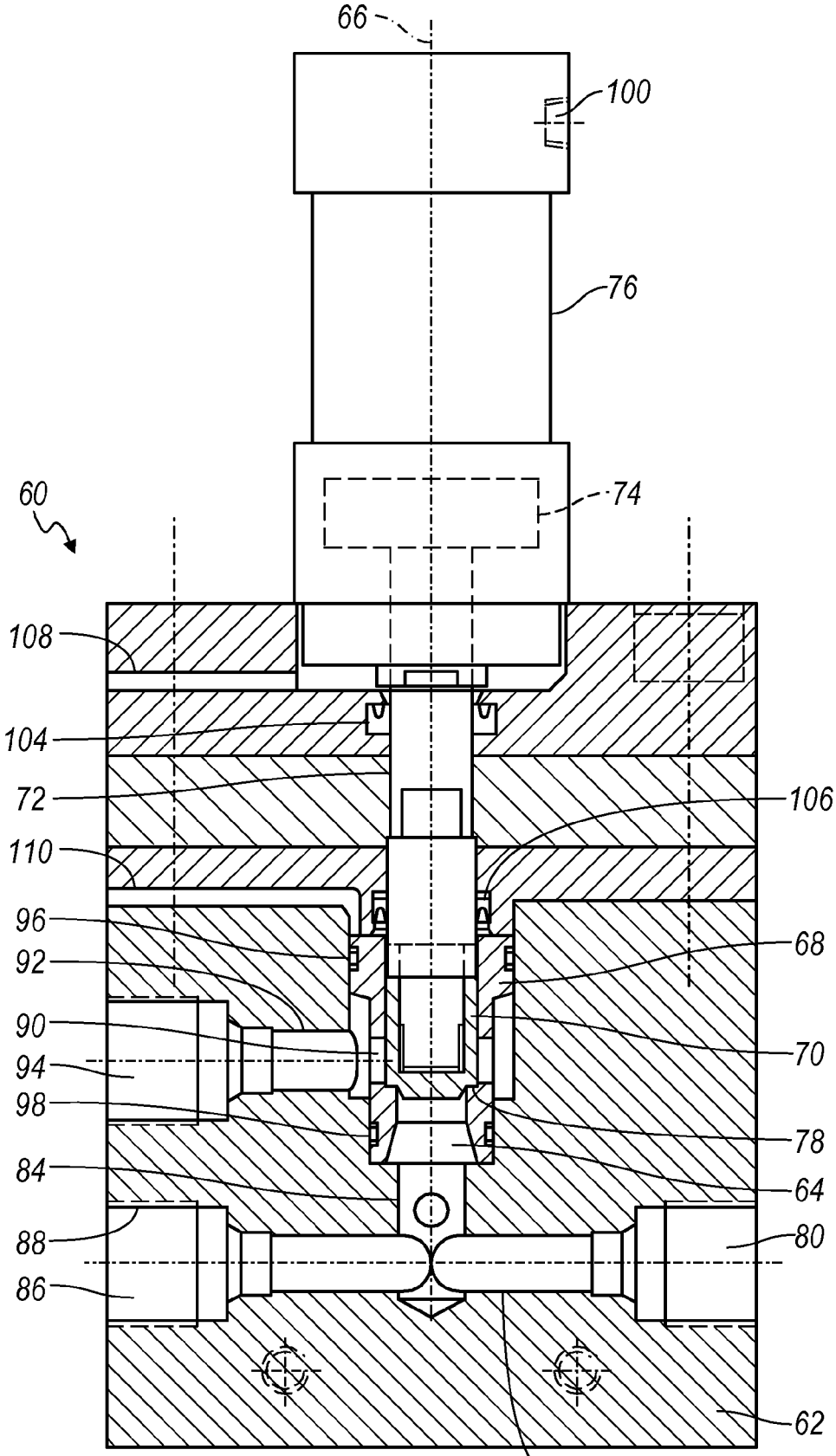
FIG. 2 is a cross section of a pressure relief valve for use in the hydroforming process shown in FIG. 1.

The single stage proportional relief valve 60 shown in FIGS. 1 and 2 includes a valve body 62 formed with a chamber 64, which is aligned with a central axis 66 and contains a cartridge valve insert 68. A control element, such as a cartridge valve poppet 70 displaceable along axis 66, is secured to a rod extension 72 that is connected to a displaceable piston 72 located in a hydraulic cylinder 76. Valve 60 is shown closed with poppet 70 engaged with a seat 78 formed on valve insert 68.

An inlet port 80 formed in the valve body 62 communicates hydraulically with the interior of the workpiece 12 and through valve body passages 82, 84 with chamber 64. Preferably port 80 is connected hydraulically with the hydroforming die 14, 16 at the end of the die where water exits the workpiece 12. When valve 60 is so arranged, outlet port 86 is closed with a plug that engages screw threads 88. Alternatively, valve 60 may be connected hydraulically with the hydroforming die at the end where water enters the workpiece 12, in which case, outlet port 86 communicates hydraulically with the interior of the workpiece and through valve body passages 82, 84 with chamber 64, and inlet port 80 is closed.

The valve insert 68 is formed with radial fluid ports 90, which communicate through chamber 64, a valve passage 92 and an outlet port 94 to tank 46, which contains water at relatively low pressure. Seals 96, 98 prevent leakage between chamber 64 and insert 68.

Oil is supplied to hydraulic cylinder 76 above piston 74 through port 100, in which oil pressure is regulated by the electronically-controlled, hydraulic proportional pressure relief valve 48. A low pressure oil seal 104 and a high pressure oil seal 106 resist oil leakage between rod extension 72 and the valve body 62. Two oil drains 108, 110 carry oil from the valve body to an oil sump.

In operation, the fill and form fluid, preferably water, passes through the workpiece, which is to be formed in die 14, 16, and passes across the single stage proportional relief valve 60 creating pressure in the workpiece. The pressure in the workpiece 12 is controlled by the relative magnitudes of a force acting upward on the valve poppet 70 and applied by water in chamber 64 and a force acting downward on poppet 70 that is applied by the piston 74 in the control cylinder 76. The downward force is the product of oil pressure on cylinder 76 and the area of the piston 74 on which oil pressure is acting. The upward force is the product of water pressure in chamber 64 and the area of the poppet 70 on which the water pressure is acting.

The pressure of oil in control cylinder 76 is determined in response to control signals supplied by controller 54 to the solenoid 52 of hydraulic proportional pressure relief valve 48. The pilot hydraulic oil is supplied from the press tooling system at a predetermined pressure of 2800 pounds per square inch (psi). The pilot oil is routed through the proportional pressure relief valve 102 to the control cylinder 76. The proportional relief valve 48 modulates the oil pressure being applied to control cylinder 76 between about 85 psi and 2800 psi in response to the electronic control command signals supplied to the hydraulic proportional relief valve 102. Relief valve 48 allows the oil pressure and force applied to piston 74 to be increased and decreased as required during the forming process in response to the electronic control signal. The magnitude of the differential force across valve 60 is dependent on the pressure required to form the workpiece 12.

Hydroforming fluid is supplied to the workpiece 12 first by the hydroform fill pump 24 that is part of the press hydroforming system. The fluid enters the workpiece 12 at a preset maximum pressure of 1800 psi., but the fill pressure is normally less then 1000 psi. As the fluid passes through the workpiece 12 and across single stage proportional relief valve 60, the oil pressure in control cylinder 76 is controlled to create the force required to displace the cartridge poppet 70 from its seat 78, thereby opening valve 60 and allowing the forming fluid to flow from inlet port 80 to outlet port 94, creating a pressure drop in the workpiece, and producing the desired internal pressure in the workpiece that is required for the fill process. Once fill pressure is achieved, the die portions 14, 16 are completely closed by the press 17.

Then, the form pump 34 is used to pump forming fluid into the workpiece 12 at a preset pressure of 10,000 psi. Concurrently, the oil pressure in control cylinder 76 of the single stage valve 60 is increased along a ramp raising the form pressure in the workpiece 12. When the pressure in the workpiece 12 reaches the fill pressure, the fill pump 24 is blocked out of the system and the form pump 34 becomes the single supply source of fluid to the workpiece. By increasing the oil pressure on control piston 74, greater downward force on poppet 70 is produced, requiring more force to open the poppet in valve 60. Form pressure in the workpiece 12 is part-dependent, but it usually never exceeds 8,000 psi. Form pressure in the workpiece 12 is controlled by the differential force across the poppet, control element 70 of single stage proportional relief valve 60.

The filling phase of the hydroforming process, performed before fully closing the two dies, requires water pressure be sufficiently high to prevent the workpiece tube from collapsing but not so high that the tube distorts. During the fill phase, oil pressure is electronically adjusted to achieve the desired water fill pressure. This situation continues while the press closes the die and applies the necessary tonnage required by the forming phase. After the press 17 develops sufficient tonnage to keep the die closed, oil pressure is electronically increased until the desired form pressure is achieved.

As water pressure increases, control cylinder 76 holds the poppet 70 closed until sufficient water pressure lifts the control cylinder 76. When the water pressure lifts poppet 70 from seat 78, water returns to tank 46 through port 94, and water pressure falls until the control cylinder 76 again can force the poppet 70 closed. This opening and closing of poppet 70 effectively controls water pressure in the workpiece 12.

While certain embodiments of the present invention have been described in detail, those familiar with the art to which this invention relates will recognize various alternative designs and embodiments for practicing the invention as defined by the following claims.

What is claimed is:

1. A system for hydroforming a workpiece containing hydraulic fluid at elevated pressure, comprising:

a die in which the workpiece is formed;

a source of variable control pressure;

a tank at low pressure;

a valve including a displaceable control element that alternately moves between an open state and a closed state, opening and closing, respectively, a passage that hydraulically connects the fluid in the workpiece to the tank in response to relative magnitudes of a first force applied to the control element by the control pressure source and a second force applied to the control element by pressure of the fluid in the workpiece acting on the control element in opposition to the first force; and a pump for supplying fluid to the workpiece and the valve after the workpiece is being filled with fluid, while the die is closed and the workpiece is being formed in the die.

2. The system of claim 1 further comprising:

a second pump for supplying fluid to the workpiece and the valve while the workpiece is being filled with fluid and before the die is closed.

3. The system of claim 1 wherein:

the source of control pressure further comprises a hydraulic cylinder containing a displaceable piston having first area on which the control pressure acts; and the valve further comprises a displaceable poppet secured to the piston and having a second area on which the pressure of the fluid in the workpiece acts, the first area being greater than the second area.

4. The system of claim 1 wherein the control pressure biases the control element toward the open state, and the pressure of the fluid in the workpiece biases the control element toward the closed state.

5. The system of claim 1 further comprising:

the source of control pressure further comprises a hydraulic cylinder containing a displaceable piston having a first area on which the control pressure acts; and wherein the valve further comprises a chamber; a valve insert located in the chamber, communicating with the tank and the fluid in the workpiece, and including a seat; and a displaceable poppet located in the valve insert, secured to a piston, engageable with the seat and having a second area on which the pressure of the fluid in the workpiece acts, the first area being greater than the second area.

6. The system of claim 1 further comprising:

a second source of control pressure at a constant magnitude of pressure;

a controller for repetitively producing control signals, each of the signals representing a desired magnitude of the pressure in the workpiece; and a hydraulic proportional pressure relief valve communicating with the second control pressure source, for producing the variable control pressure in response to the control signals.

7. A system for hydroforming a workpiece containing hydraulic fluid at elevated pressure, comprising:

a die in which the workpiece is formed;

a source of variable control pressure;

a source of low pressure;

a valve including:

a hydraulic cylinder containing a displaceable piston having a first area on which the control pressure acts;

a chamber communicating with the source of low pressure and the fluid in the workpiece;

a valve seat located in the chamber; and a displaceable poppet located in the chamber, secured to the piston, engageable with the seat and having a second area on which pressure of the fluid in the workpiece acts, the poppet opening and closing a connection through the chamber between the fluid in the workpiece and the source of low pressure.

8. The system of claim 7 further comprising:

a first pump for supplying fluid to the workpiece and the valve while the workpiece is being filled with fluid and before the die is closed.

9. The system of claim 7 further comprising:

a second pump for supplying fluid to the workpiece and the valve after the workpiece is being filled with fluid, while the die is closed and the workpiece is being formed in the die.

10. The system of claim 7 wherein the piston biases the poppet toward an open state, and the pressure of the fluid in the workpiece biases the poppet toward a closed state.

11. The system of claim 7 further comprising:

a second source of control pressure at constant magnitude of pressure;

a controller for repetitively producing control signals, each of the signals related to a desired magnitude of the pressure in the workpiece; and a hydraulic proportional pressure relief valve communicating with the second control pressure source, for producing the variable control pressure in response to the control signals.

12. The system of claim 7 wherein the first area is greater than the second area.

13. The system of claim 7 wherein the tank poppet is displaced in response to the relative magnitudes of a first force applied to the poppet by the control pressure source and a second force applied to the poppet by pressure of the fluid in the workpiece acting on the poppet in opposition to the first force.

14. A valve for controlling pressures at which a workpiece is filled with hydraulic fluid and formed by the fluid pressure comprising:

a hydraulic cylinder containing a displaceable piston having first area on which a variable control pressure acts;

a chamber communicating with a source of low pressure and the fluid in the workpiece;

a valve seat located in the chamber; and a displaceable poppet located in the chamber, secured to the piston, engageable with the seat and having a second area on which the pressure of the fluid in the workpiece acts, the poppet opening and closing a connection through the chamber between the fluid in the workpiece and the source of low pressure.

15. The valve of claim 14 further comprising:

a controller for repetitively producing control signals, each of the signals related to a desired magnitude of the pressure in the workpiece; and a hydraulic proportional pressure relief valve communicating with a second control pressure source, for producing the variable control pressure in response to the control signals.

16. The valve of claim 14 further comprising a valve insert located in the chamber and formed with the valve seat.

* * * * *